United States Patent [19]

Tanaka et al.

[11] 4,010,343

[45] Mar. 1, 1977

[54] MICROWAVE OVENS

[75] Inventors: Junzo Tanaka, Fujiidera; Tsuyoshi Takami, Nara; Toshio Kai, Yamatokoriyama, all of Japan

[73] Assignee: Matsushita Electric Industrial Co., Ltd., Osaka, Japan

[22] Filed: Dec. 4, 1975

[21] Appl. No.: 637,703

[30] Foreign Application Priority Data

Dec. 9, 1974 Japan ..... 49-141802
Apr. 23, 1975 Japan ..... 50-56020

[52] U.S. Cl. ..... 219/10.55 D; 174/35 R; 174/35 MS

[51] Int. Cl.[2] ..... H05B 9/06

[58] Field of Search ..... 174/35 R, 35 MS; 219/10.55 D, 10.55 R

[56] References Cited

UNITED STATES PATENTS

| | | | |
|---|---|---|---|
| 2,782,292 | 2/1957 | Long | 219/10.55 D |
| 2,920,174 | 1/1960 | Haagensen | 219/10.55 D UX |
| 2,958,754 | 11/1960 | Hahn | 219/10.55 D |
| 3,304,401 | 2/1967 | Long | 219/10.55 D |
| 3,879,595 | 4/1975 | Lamb | 219/10.55 D |

FOREIGN PATENTS OR APPLICATIONS

| | | | |
|---|---|---|---|
| 1,180,232 | 2/1970 | United Kingdom | 219/10.55 D |

OTHER PUBLICATIONS

Data Sheet EMC-700, "Tecknit", Technical Wire Products Inc., 1972.

*Primary Examiner*—Arthur T. Grimley
*Attorney, Agent, or Firm*—Stevens, Davis, Miller & Mosher

[57] ABSTRACT

Microwave oven is provided with an improved door screen which allows an undisturbed clean observation of the heating chamber and at the same time assures safety and durabiiity in use. The door screen comprises an electromagnetic wave shielding means made of a metal mesh interposed between a pair of transparent plates. The metal mesh is constituted by electrically conductive woven wires having a predetermined diameter with the space between the wires also being numerically predetermined.

5 Claims, 6 Drawing Figures

MICROWAVE OVENS

The present invention relates generally to an electromagnetic microwave oven and in particular a structure of door screen for such microwave oven which permits a straightforward observation of a heating chamber or cavity formed in the oven and assures an enhanced safety against the leakage of electromagnetic energy as well as an improved durability in use.

As is well known, the microwave oven is employed to inductively heat foods by utilizing electromagnetic wave at a high frequency in the order of 2450 MHz. The oven is provided with a closing and opening door which is formed with a door screen, so that the door makes it possible to observe the cooked state of food located in the heating cavity or chamber. In the hitherto known microwave oven, a perforation metal plate manufactured by a number of press-punch processes is used for suppressing the leakage of electromagnetic energy from the door screen. Such shield plate can certainly be manufactured at economically acceptable costs. However, it has disadvantages that the aperture ratio is restricted and the observation of the heating chamber is uneasy. For example, when an aluminium plate of 1.0 mm thick is perforated through eight steps of press-punching, the aperture ratio amounts to at highest about 35%.

In connection with the structure of the door screen, U.S. Pat. No. 2,958,754 teaches a structure comprising a metal mesh sandwiching between refractory glass plates. U.S. Pat. No. 3,431,349 discloses a structure in which a transparent coating of a synthetic resin material such as acryl resin is applied to both sides of a metal mesh. Concerning the dimension of the metal mesh, the first mentioned patent suggests the use of screen of at least 12 meshes. However, there is no prior art which teach the design of the door screens based on the scrutinized relationship between the mesh screen and the leakage of electromagnetic energy.

An object of the present invention is therefore to provide a microwave oven provided with a door screen which facilitates the observation of the heating chamber and assures a safety against the leakage of electromagnetic energy as well as durability in use.

Another object of the invention is to provide a microwave oven including a door screen which can be easily manufactured and has an aesthetically comfortable appearance.

Further object of the invention is to provide a microwave oven including an improved door screen which is so constructed as to exert possibly little influence to the distribution of electric field in the heating chamber and thereby increase the safety in use.

According to a feature of the invention, there is proposed a microwave oven which comprises a body having a heating chamber or cavity, a door mounted on the body and adapted to close and open a front opening of the heating chamber, a microwave generator for emitting microwave energy into the heating chamber and a door screen formed in the door, the door screen comprising an electromagnetic wave shielding means composed of a metal mesh interposed between paired transparent plates, wherein the metal mesh is made of wires having a diameter $\phi$ in the range of 0.1 to 0.4 mm with a space $l$ between the wires (hereinafter refered to as inter-wire space) in the range of 0.18 to 0.92 mm, the diameter and the inter-wire space being so selected that the ratio the diameter and the inter-wire space takes a value smaller than those represented by an interporation curve passing through points corresponding to the values of ratio $l/\phi$ equal to 2.2, 3.3 and 4.4 for the values of the diameter $l$ equal to 0.4, 0.2 and 0.1 mm, respectively.

The above and other objects, features as well as advantages of the invention will be made more apparent by examining the following description of preferred embodiments of the invention. The description makes reference to the accompanying drawings, in which.

Figure 4:
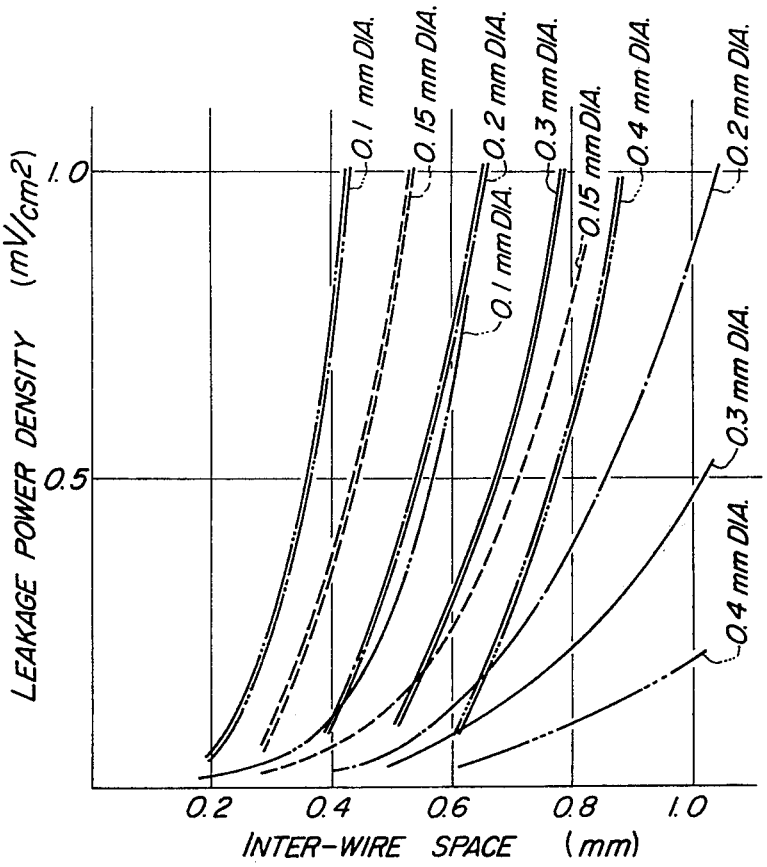
Figure 5:
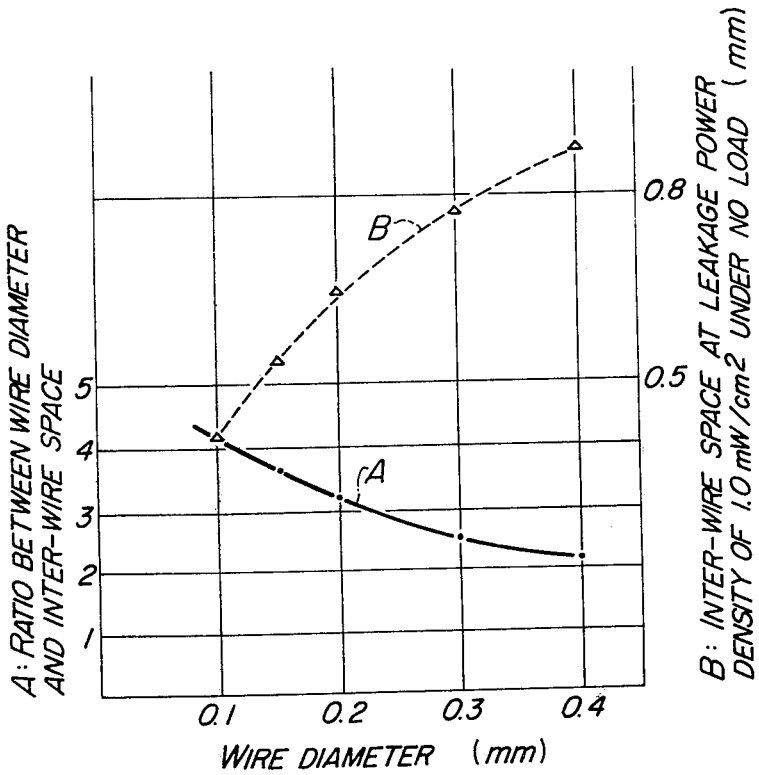
Figure 6:
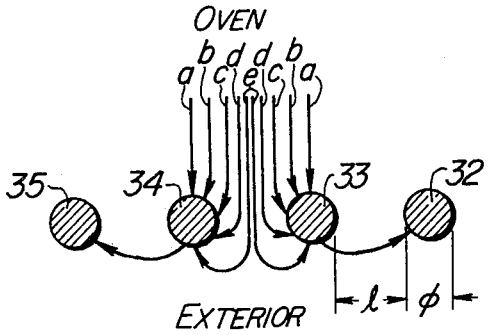

FIG. 4 graphically illustrated relationships between the inter-wire spaces $l$ of a metal mesh for a door screen and the power density of leaking electromagnetic energy;

FIG. 5 graphically illustrates variations of the inter-wire space and the ratios thereof to the wire diameters as functions of variation in the wire diameter; and FIG. 6 is to illustrate schematically the phenomenon of electromagnetic energy leakage.

Before entering into description of examplified embodiments of the invention, the phenomenon of the leakage of electromagnetic energy from the door screen of a microwave oven will be explained in order to have a better understanding of the invention.

Referring to FIG. 6, a metal mesh destined to be arranged at the door screen of the microwave even is composed of a number of wires of which only four wires 32, 33, 34 and 35 are shown in FIG. 6. Although the leakage of high frequency energy is shown as occurring between the wires 33 and 34, it will be appreciated that similar leakages will take place among the other wires. A high frequency power source is disposed with in the microwave oven to heat inductively objects to be cooked and generates lines of electric force such as those indicated by *a*, *b*, *c*, *d* and *e*. As is well known, these lines of electric force run normal to the surfaces of the mesh wires 32, 33, 34 and 35 due to the inherent nature thereof. Thus, the lines of electric forces such as *a* and *b* will extend substantially straight-forwardly to the metal wires 32 and 34, while the lines of electric force such as the lines *c* located in the gap or space between the wires 33 and 34 will tend to run along a curred path and enter the wires at the lateral surfaces. The lines of electric forces such as *d* and *e* extending through the center portion of the gap will exit once from the heating chamber and enter the metal wires from the exterior side of the oven. It is believed that the lines of electric force which run exteriorly of the oven chamber would induce additional lines of electric force, resulting in the leakage of the electromagnetic energy. In this connection, it will be appreciated that, if the distribution of the electric lines of force is definite as described above, the metal mesh could be suitably designed so as to prevent the leakage of the electromagnetic energy. However, in reality, such distribution of the electric lines of force can not be definitely determined due to the interactions between the lines of electric force at the numerous gaps in addition to the inevitable uneveness in the distribution of electric lines of force within the oven chamber. Furthermore, additional disturbing factors such as interface or boundary conditions between the viewing window and the door body, different resistances of contacts between the metal wires as well as surface current produced in the metal walls of the oven due to the electric field of the possible standing wave will make it difficult to determine the definite pattern of the leaking electromagnetic wave and hence to design the corresponding structure of the wire mesh to suppress such leakage.

The present invention contemplates to overcome the above difficulties.

Now, the invention will be described with reference to FIGS. 1 to 5.

The microwave oven is usually used to cook food by dielectric heating by making use of a high frequency in the order of 2540 MHz. As can be seen from FIGS. 1 and 2, the microwave oven comprises an oven body 1 defining a heating chamber or cavity 2 therein and a door 3 mounted on the oven body 1 so as to open and close a front opening or access aperture of the heating covity 2. The door 3 is provided with a door handle 4 for the opening and closing manipulation of the door. There is formed a door screen 5 in the door 2 through which the inside of the heating cavity can be observed. A control panel 6 is mounted on a front top of the oven body 1 and is provided with a time scale plate 7 for a timer and a dial plate 8 in a juxtaposition. The dial plate 8 gives indications of heating time intervals for every selected variety of food to be cooked in respect of the quantity thereof. A control knob 9 is selectively set in dependence on the variety of food to be cooked. Thereafter, a timer knob 10 is turned to set a timer indicator needle 11 to a position on the dial 8 indicating the quantity of the selected variety of food. Then, the timer (not shown) generates an optimum cooking duration for the selected variety of food. Reference numeral 12 designates a cooking button for triggering the cooking operation. Numeral 13 denotes a cooking lamp which is illuminated while the high frequency wave is being generated.

A magnetron 14 for emitting high frequency energy into the heating cavity is mounted on the oven body 1 over the heating cavity. A stirrer vane 15 rotatably mounted on a supporting shaft 16 is adapted to be rotated by a wind used to cool the magnetron, thereby to stir the high frequency field in the heating cavity. A partition board 17 serves to isolate the stirrer vane from the cooking cavity and a tray 18 for receiving a cooked article 19.

Figure 1:
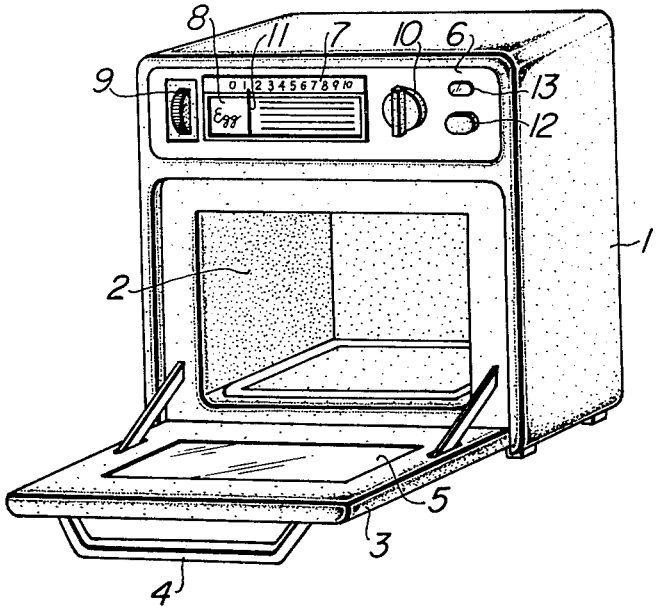
FIG. 1 shows an overall perspective view of a microwave oven with a door held open.
Figure 2:
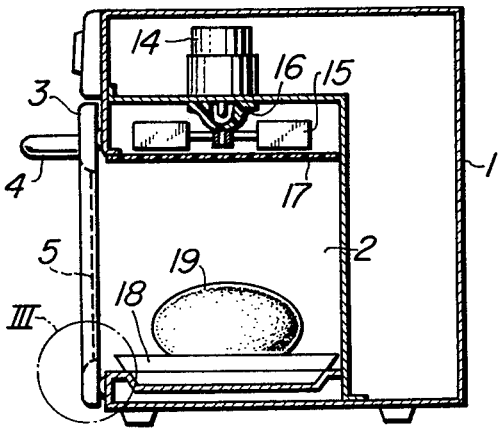
FIG. 2 shows a longitudinal sectional view of the same.
Figure 3:
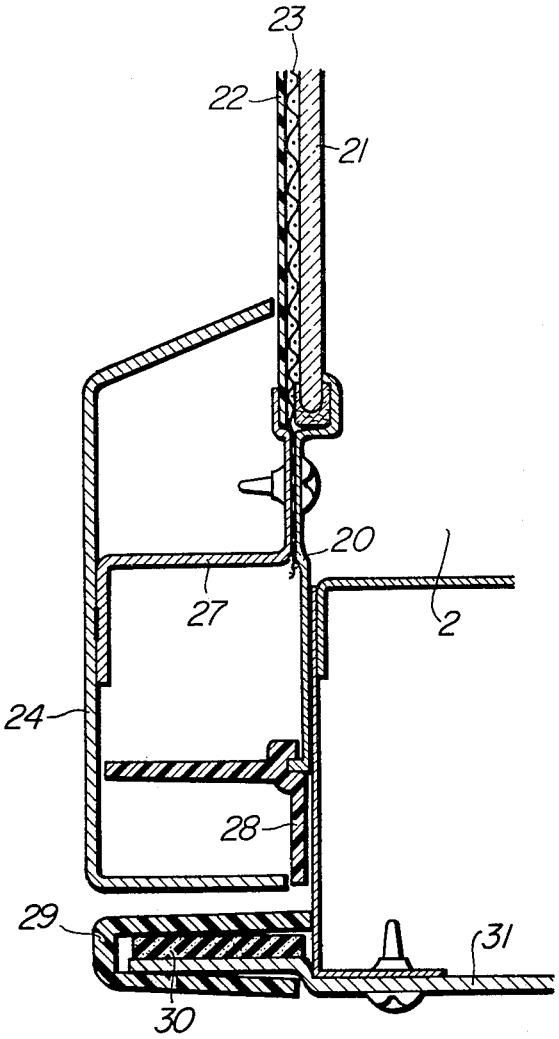
FIG. 3 is a fragmental enlarged view of a portion encirculed by III in FIG. 2.

As is shown in FIG. 3 which is an enlarged fractional view showing a portion A of FIG. 2, the door body 3 comprises a door inner frame 20 of a metallic plate disposed adjacent to the heating cavity. The metallic plate is coated with an insulation material such as hard almite. The door body 3 further comprises a tempered glass plate 21, a transparent synthetic resin layer 22 and a wire screen 23 which constitute the door screen. The wire screen or mesh 23 serves as a shield means for preventing the leakage of electromagnetic wave. The door screen is securedly supported by a door frame structure 24 made of an iron plate which is usually coated with a point from an aethetic viewpoint. Reference numeral 27 indicates an abutting metal plate which has one end portion secured to a front wall portion by welding and the other end portion secured to the door inner frame 20 by means of screws 25. It can be seen from FIG. 3 that the wire screen or mesh 23 is sandwiched between the tempered glass plate 21 and the synthetic resin layer 22 and clampingly held by the painted abutting plate 27 and the almite anodized door inner frame 20. It will be noted that the free end portion of the wire screen or metal mesh 23 is directly sandwiched between the abutting plate 27 and the door inner frame 20 in a surface contact relation, in order to completely suppress any leakage of electromagnetic wave from the heating cavity.

Reference numeral 28 designates a molded resin piece which serves to prevent flakes of food from entering the electromagnetic wave choke cavity. A ferrite rubber member 30 for attenuating the electromagnetic energy is mounted on a forward extention of a bottom plate 31 and is covered by a resin cover 29 for a mechanical protection.

It has been found that, when the wire screen 23 is made of an electrically conductive material having been subjected to no surface treatment, an imperfect contact will occur between the wire screen 23 and the abutting plate 27 if the microwave oven is operated for a long time, due to the fact that a paint layer coated on the wire screen at outside thereof from the aethetic viewpoint becomes softened and the wire screen 23 is increasingly embedded in the softened paint layer under the clamping pressure exerted by the screw 25. This will result in a generation of discharge between the wire screen 23 and the abutting plate 27, which in turn gives rise to generation of heat, incurring deterioration of the electromagnetic energy leaking suppression function of the choke cavity and the screen.

In order to obviate such difficulty, it is proposed according to one aspect of the invention that the wire screen 23 is made of stainless steel material having a great tensile strength and provided with an oxide coating of less than 5 $\mu$ in thickness by an oxide melting treatment, fluorization or oxidization treatment or the like surface treatments. Further, the wire screen 23 should be blackened so as to make the observation of the heating chamber easy and comfortable by reducing the reflection rays. In this connection, it has been found that, when the thickness of the oxide coating on the wire screen exceeds the value of 5 $\mu$, the stainless steel material constituting the wire screen tends to become fragile as corroded by the treatment for depositing the oxide coating. Besides, the electric resistance at the surface of the wires of the screen mesh 23 will be increased to raise a problem in respect of the safety in operation.

As the glass plate 21, it is preferred to employ a glass plate strengthened chemically through an ion exchange treatment or the like rather than a thermally strengthened glass for the following reasons;

1. In the case of the thermally strengthened glass plate, any appreciable effect of strengthener will not appear when the thickness of the glass plate to be thermally treated is less than 3 mm. In other words, the thermal treatment of the glass plate having a thickness less than 3 mm would be of no use. On the contrary, a glass plate having thickness far less than 3 mm can be satisfactorily strengthened when the glass plate has been subjected to the chemical strengthening treatment during the manufacturing process which is quite different from that of the thermally strengthened glass plate. The chemically strengthened glass plate exhibits an extremely high inner stress per unit area as compared with the thermally strengthened glass plate. In reality, the chemically strengthened glass plate has a shock strength as twice high as that of the thermally glass plate, when the thickness of glass plate is in the order of 3 mm.

Thus, the use of chemically strengthened glass for the glass plate 21 will allow the thickness thereof to be considerably reduced as compared with the corresponding glass plate of a conventional microwave oven, which means a saving of glass material and associated reduction in the manufacturing costs of the oven. Further, the use of the chemically strengthened glass plate in the structure according to the invention will permit the choke portion of the door inner frame 20 to be made shallow, which in turn facilitates the manufacturing of the choke portion and at the same time obviates the warping tendency of the finished choke portion. The transparency of the door inner frame 20 can thus be desirably improved. Simultaneously, a considerable sappresion of the leakage of electromagnetic energy can be accomplished.

2. The thermally strengthened glass has a characteristic property that the strengthening layer will lie in a deeper portion of the glass plate with non-uniform partial distribution of inner stress, which is ascribable to the manufacturing process. Accordingly, when the thermally strengthened glass is partially damaged, the balance of stress maintained as a whole will be likely to be disturbed, thereby to break the glass plate into pieces. The thermally strengthened glass having such characteristic of course provides an advantage for some applications such as the use for a motor car. However, the use for the microwave range should be evaded, because there is a danger that the glass plate would be exploded for the cause of a small damage.

On the other hand, in the case of chemically strengthened glass plate, the strengthening layers lie substantially uniformly in a relatively shallow depth. Accordingly, a possible partial damage will not lead to an overall destruction or explosion of the glass plate.

In a high frequency heating oven, spits are often employed for skewering food. Such spit usually having a pointed tip will cause an electric discharge between the tip and the door screen upon the former being positioned nearer to the latter. In this conjunction, when a thermally strengthened glass plate use employed for the door screen structure according to the invention, it has been found that the glass plate will easily be fractured even for a extremely short duration of the discharge. The chemically strengthened glass plate is, however, utterly immume from such disadvantage and assures a high reliability for the door screen.

3. In the case of the thermally strengthened glass, a warp or curved profile is likely to be imparted to the glass plate during the manufacturing processes. However, the chemically strengthened glass will not undergo such warp since compressed layers are produced uniformly. Thus, the chemically strengthened glass plate can easily be fixedly mounted without being subjected to any unacceptable distortion and at the same time allows a uniform heat distribution in the glass plate accompanied with an improved transparency.
4. The glass plate subjected to the chemically strengthening treatment has an increased surface hardness. This feature protects the door screen from scratches in the use and assures a clearness or transparency of the door screen for a long period.

Next, the design and dimension of the mesh screen will be described. FIG. 4 shows graphically results of measured leakages of electromagnetic energy in dependence upon varied gap or space between wires of the metal mesh 23 in the oven structure illustrated in FIGS. 1 to 3, wherein wires having diameters of 0.1, 0.15, 0.2, 0.3 and 0.4 mm are employed. It is first to be mentioned that single line curves in FIG. 4 indicate the leakage of electromagnetic energy when the oven is loaded with a water pool of 275 $cm^3$ positioned at the centre of the heating chamber, while doubled-line curves represent the measured results for the oven which is under no load, i.e., when only the dish receptacle of glass is disposed in the heating chamber of the oven. The reason why the wire diameter is selected for the values enumerated above can be explained by the fact that, when wires of the diameter smaller than these values are employed, the webbing or weaving of the wires into a metal mesh is encountered with difficulty owing to the decreased tensile strength of the wires and incurs increased manufacturing costs. On the other hand, the wire having a diameter greater than 0.4 mm makes the wire mesh more appreciable on the observation of the heating chamber with a result that the aperture ratio and hence the transparency of the door screen are considerably degraded. It goes without saying that the use of thicker wire will increase expensibly and impractically the weight of the metal mesh 23.

Assuming that the longitudinal (warp) and the transversal (weft) wires are of the same diameter and the screen has a constant mesh size, there is a relation among the diameter $\phi$ of the wire, the space $l$ between the wires or the inter-wire space (refer to FIG. 6) and the aperture ratio $\eta$ which can be mathmatically expressed as follows:

$$\eta = l^2/(l+\phi)^2 \times 100\ (\%) \qquad (1)$$

When the space $l$ between the wires is selected greater than 0.18 mm with the wire diameter of 0.1 mm, the aperture ratio at least of 4.18% can be obtained from the above formula, which means that the transparency effect is improved over the conventional screen made of a press formed performation plate as hereinbefore described. However, when the aperture ratio becomes smaller than 40%, then the transparency of the screen will approach to that of the conventional screen and make the use of the metal mesh meaningless. Accordingly, the lower limit of the inter-wire space $l$ should be selected at 0.18. On the other hand, the upper limit value of the inter-wire space $l$ should preferably set at 0.88 mm, because otherwise the wire diameter $\phi$ would have to be selected at a value greater than 0.4 mm from the standpoint of suppressing the leakage of electromagnetic energy as hereinafter described. Such dimension of the wire diameter of course would provide the aforementioned disadvantage.

According to the IEC (International Electric Comittee) standard it is specified that the power density of leaking electromagnetic wave should be lower than 1 $mW/cm^2$ when a water load of 275 $cm^3$ is placed in the heating chamber at the center position. However, according to the invention, the leakage power density is set at a value smaller than 1 mW under no-lead condition, since the leakage power density determined on the basis of the water load will possibly be exceeded under a light load condition. For example, in the case of cooking a piece of bread or an egg which is frequently encountered in the practical application, the leakage power density may amount to several miliwatts/cm². Additionally by selected the leakage power density under no-load condition as above mentioned, uneveness in the manufactured metal meshes can be compensated to a reasonable degree.

FIG. 5 shows graphically the relations of the inter-wire space $l$ and the ratio $l/\phi$ between the space $l$ and the wire diameter as functions of the wire diameter when the leakage power density is at 1 mW/cm² under no-load condition. As can be seen from the curve A in FIG. 5, the ratio $l/\phi$ between the inter-wire space $l$ and the wire diameter $\phi$ (refer to FIG. 6) is increased, as the wire diameter $\phi$ is decreased. This may be explained by the fact that the mesh size or grid constant of the wire mesh which has to be decreased in the proportion of the reduction of wire diameter, will causes the inter-wire space $l$ to approach the wavelength of the high frequency energy, as a result of which the number of the electric lines of force falling within the gap between the wires is reduced. The curve B in FIG. 5 shows that the inter-wire space can be increased, as the selected wire diameter is increased. This may be ascribable to the fact that the aperture ratio is reduced, as the wire diameter is increased even with the same inter-wire space maintained, wherein the increased wire diameter contributes to the reduction in the number of the electric line of force entering the wire at the lateral sides thereof. Accordingly, upon webbing the mesh, the wire diameter as well as the inter-wire space are selected at values smaller than those represented by the curves A and B shown in FIG. 5.

In the above description, the wire diameter $\phi$ and the inter-wire space $l$ have been selected as the parameters for designing the screen mesh 23 according to the invention. However, these parameters may be easily replaced by another parameter in "mesh" in accordance with the formula: $A = 25.4/(\phi + b)$.

In the foregoing description, it is assumed that the metal mesh 23 has the same inter-wire space or gap either in the longitudinal or the transversal direction. In case the space between the warp wires is different from the space between the weft wires, the inter-wire space may be defined as the space between the mid points of the adjacent rectangular mesh apertures for obtaining substantially same results. Similarly, when the diameter of the warp wire is different from that of the weft wire, an averaged diameter of the both wire diameters may be employed.

When the mesh screen is to be woven, the warp wires are suspended in tension longitudinally and the odd numbered warp wires as counted from the one side being lifted while the even numbered wires being lowered, thereby to form an interlaced passage therebetween through which the weft wire is passed. The above steps are repeated with the odd and even numbered warp positions alternatively exchanged, as is in the case of the usual weaving machines. It will thus be appreciated that the longitudinal or warp wire should have a sufficient tensile strength for allowing the weaving operation, while the weft wire requires the tensile stength of a degree sufficient for the threading thereof through the passage between the warp wires. In this manner, a limitation is practically imposed on the diameter of the longitudinal wire with a view to evading degraded production efficiency, although thinner wire will theoritically bring about a more desirable transparency for use in the door screen of the high frequency oven. According to an aspect of the invention, it is therefore proposed to use a thicker wire for the warp while a thinner wire is used for the weft, thereby to dispose of the above difficulty.

When the wire of the indentical diameter is used both for the warps and the wefts, the webbed mesh has a tendency to become warped, which necessiates a use of a pad for pressing the mesh upon assemblying the door screen. If such troublesome assemblying is to be evaded, the woven or webbed mesh must be milled flat beforehand. In this conjunction, according to the invention, thick wires are used for one of the mesh wires, while thin wires are used for the other mesh wire, whereby the tendency of the finished mesh to become warped can be satisfactorily overcome. Thus, the wire mesh according to the invention can be assembled off hand without requiring additional step to make the mesh flat enforcively.

As will be appreciated from the foregoing description, the metal mesh according to the invention can be manufactured from wires of a relatively small diameter, whereby a door screen having an enhanced transparency can be attained. By making the wire thinner the ratio between the wire diameter and the inter-wire space can be increased for a given leakage of electromagnetic energy, whereby a metal mesh having an increased aperture ratio and a correspondingly improved transparency is available. Inversely, for a given aperture ratio, the leakage of electromagnetic energy can be suppressed to an increased degree.

Since the materials to be heated by the oven are frequently rather flattened, the wire for the metal mesh may be so selected that the thicker ones are for the transversal wires for the mesh with thinner ones for the longitudinal wires. In such case, more facilitated and comfortable observation of the heating cavity can be assured even for the same aperture ratio.

Additionally, even when the viewing window has some dimensional error in height and/or width, the selection of the wire diameter for the metal mesh according to the invention will provide a good apparence of the door screen from the aethetic view point.

It is finally added that the invention is never restricted to the illustrated and described embodiments. Many modifications and variations may be made for those skilled in the art without departing from the spirit and scope of the invention. For example, instead of employing wires of different diameter for the warp and the weft wires of the metal mesh, a wire having a great tensile strength such as stainless steel wire may be used for the warp wires, while an inexpensive wire such as aluminium wire can be used for the weft wires. Further, the metal mesh for the door screen which has an electric conductivity of a resonable value is effective to prevent the leakage of electromagnetic energy.

What is claimed is:

1. A microwave oven comprising a body having a heating chamber formed therein, a door mounted on said body and adapted to close and open a front opening of said heating chamber, a microwave generator for emitting microwave energy into said heating chamber and a door screen provided in said door, characterized in that said door screen comprises an electromagnetic wave shielding means composed of a metal mesh interposed between transparent plates, wherein said metal mesh is made of wires having a diameter $\phi$ in the range of 0.1 to 0.4 mm with a space $l$ between the wires being in the range of 0.18 to 0.92 mm, and that said diameter and said space are so selected that a ratio $l/\phi$ takes a value smaller than values represented by an interpolation curve passing through points corresponding to the values of ratio $l/\phi$ equal to 2.2, 3.3 and 4.3 for the values of said diameter $\phi$ equal to 0.4, 0.2 and 0.1 mm, respectively.

2. A microwave oven as set forth in claim 1, wherein said metal mesh is composed of longitudinal and transversal wires of different diameters.

3. A microwave oven as set forth in claim 1, wherein said metal mesh is composed of longitudinal and transversal wires of different materials.

4. A microwave oven as set forth in claim 1, wherein said metal mesh is made of a stainless steel material and coated with an oxide layer of less than 5 $\mu$ in thickness.

5. A microwave oven as set forth in claim 1, wherein one of said transparent plates located at the side of said heating chamber is made of chemically strengthened glass.

* * * * *